US008357846B2

(12) United States Patent
Strobel et al.

(10) Patent No.: US 8,357,846 B2
(45) Date of Patent: Jan. 22, 2013

(54) NOVELTY FOOD AND BEVERAGE VESSEL AND COIN BANK

(75) Inventors: Scott G. Strobel, Plymouth, CT (US); Ronald Lee Schoelkopf, White Hall, MD (US)

(73) Assignee: Progressive Specialty Glass Co., Inc., Plainville, CT (US)

( * ) Notice: Subject to any disclaimer, the term of this patent is extended or adjusted under 35 U.S.C. 154(b) by 97 days.

(21) Appl. No.: 12/769,045

(22) Filed: Apr. 28, 2010

(65) Prior Publication Data

US 2011/0226637 A1 Sep. 22, 2011

Related U.S. Application Data

(60) Provisional application No. 61/186,698, filed on Jun. 12, 2009.

(51) Int. Cl.
*G10H 3/18* (2006.01)

(52) U.S. Cl. ..... 84/1; 84/267; D9/665

(58) Field of Classification Search ..... 84/1, 267; D9/665

See application file for complete search history.

(56) References Cited

U.S. PATENT DOCUMENTS

| | | | | | |
|---|---|---|---|---|---|
| D21,278 | S | * | 1/1892 | West | D9/665 |
| D21,736 | S | * | 7/1892 | Thuemler | D9/665 |
| D34,785 | S | * | 7/1901 | Renninger | D9/665 |
| D40,500 | S | * | 2/1910 | Patno | D9/665 |
| 1,687,086 | A | * | 10/1928 | Erb | 446/81 |
| D107,353 | S | * | 12/1937 | Henshel | D9/665 |
| D120,672 | S | * | 5/1940 | Harris | D9/665 |
| D128,007 | S | * | 7/1941 | Sierad | D9/665 |
| D132,585 | S | * | 5/1942 | Straus | D9/665 |
| D134,507 | S | * | 12/1942 | Hershfield | D9/665 |
| D138,472 | S | * | 8/1944 | Gerson | D9/665 |
| D157,011 | S | * | 1/1950 | Stough | D9/665 |
| 2,663,866 | A | * | 12/1953 | Simpson | 340/689 |
| 3,943,815 | A | * | 3/1976 | Gilbert | 84/293 |
| 4,336,734 | A | * | 6/1982 | Polson | 84/646 |
| 4,339,979 | A | * | 7/1982 | Norman | 84/627 |
| D300,408 | S | * | 3/1989 | Couri | D9/665 |
| D318,731 | S | * | 7/1991 | Chapin | D24/198 |
| D318,921 | S | * | 8/1991 | Chapin | D24/198 |
| 5,056,681 | A | * | 10/1991 | Howes | 220/522 |
| 5,095,799 | A | * | 3/1992 | Wallace et al. | 84/609 |
| D326,158 | S | * | 5/1992 | Katz et al. | D24/198 |
| 5,117,730 | A | * | 6/1992 | Yamauchi | 84/723 |
| 5,121,668 | A | * | 6/1992 | Segan et al. | 84/646 |
| 5,167,354 | A | * | 12/1992 | Cohanfard | 224/148.2 |
| 5,197,602 | A | * | 3/1993 | Biesecker et al. | 206/514 |
| 5,373,768 | A | * | 12/1994 | Sciortino | 84/293 |
| 5,557,057 | A | * | 9/1996 | Starr | 84/617 |
| 5,739,455 | A | * | 4/1998 | Poon | 84/615 |
| 6,018,119 | A | * | 1/2000 | Mladek | 84/722 |
| 6,085,927 | A | * | 7/2000 | Kusz | 220/23.87 |

(Continued)

*Primary Examiner* — Elvin G Enad
*Assistant Examiner* — Robert W Horn
(74) *Attorney, Agent, or Firm* — McCormick, Paulding & Huber LLP

(57) ABSTRACT

A vessel for containing substances includes a body adapted to containing beverages or snacks, a light source, a sound module, activation switches, and a power source. The body may be provided in the shape of a guitar or other musical instrument, and may optionally include a threaded opening for receiving the substances and apertures adapted to receive ends of a strap so the vessel may be worn or otherwise supported. The vessel may further include a closure having an opening adapted to receive a straw or coins. A removable insert may be provided to slide into the opening formed in the body and rest therein.

20 Claims, 6 Drawing Sheets

U.S. PATENT DOCUMENTS

D440,487 S * 4/2001 Leach ..... D9/665
D440,869 S * 4/2001 Leach ..... D9/665
D442,232 S * 5/2001 Lee et al. ..... D21/405
D456,856 S * 5/2002 Kane et al. ..... D21/405
6,527,402 B1 * 3/2003 Borri ..... 362/86
6,591,524 B1 * 7/2003 Lewis et al. ..... 40/324
6,781,049 B2 * 8/2004 Taylor ..... 84/477 R
D499,961 S * 12/2004 Wilson ..... D9/665
6,872,116 B1 * 3/2005 Dunnum et al. ..... 446/73
D537,558 S * 2/2007 Lin ..... D27/148
D542,464 S * 5/2007 Chen ..... D27/148
D555,006 S * 11/2007 Eisenbraun ..... D9/665
7,384,164 B2 * 6/2008 Yu ..... 362/101
D576,165 S * 9/2008 Yow et al. ..... D14/400
7,465,870 B1 * 12/2008 Homan ..... 84/743
D604,179 S * 11/2009 Rodriguez ..... D9/665
7,690,533 B2 * 4/2010 Stilley ..... 222/113
7,714,218 B2 * 5/2010 Papenfus ..... 84/314 R
7,732,687 B2 * 6/2010 Shaffer ..... 84/314 R
D619,476 S * 7/2010 McClellan et al. ..... D9/665
D622,027 S * 8/2010 Acunzo et al. ..... D1/106
7,825,313 B2 * 11/2010 Shaffer ..... 84/293
7,927,032 B2 * 4/2011 Sanchez ..... 401/129
8,136,684 B2 * 3/2012 Becotte ..... 215/386
D658,502 S * 5/2012 Strobel et al. ..... D9/665
2001/0034917 A1 * 11/2001 DuCey ..... 15/167.1
2002/0097195 A1 7/2002 Frank
2002/0185388 A1 * 12/2002 Su ..... 206/217
2004/0206224 A1 * 10/2004 Cohen ..... 84/410
2005/0178739 A1 * 8/2005 Deir ..... 215/6
2005/0183566 A1 * 8/2005 Nash ..... 84/601
2006/0213857 A1 * 9/2006 Chen ..... 215/11.1
2008/0260450 A1 * 10/2008 Sanchez ..... 401/126
2011/0088535 A1 * 4/2011 Zarimis ..... 84/645
2011/0192273 A1 * 8/2011 Findley et al. ..... 84/743
2011/0226637 A1 * 9/2011 Strobel et al. ..... 206/216

* cited by examiner

NOVELTY FOOD AND BEVERAGE VESSEL AND COIN BANK

CROSS REFERENCE

This application is entitled to the benefit of and incorporates by reference essential subject matter disclosed in U.S. Provisional Patent Application No. 61/186,698 filed on Jun. 12, 2009.

BACKGROUND OF THE INVENTION

1. Field of the Invention

The present invention relates to vessels for containing beverages, snacks, or coins.

2. Brief Description of Related Technology

Current devices adapted to containing beverages, snacks or other substances include containers of plastic, glass, ceramic, or plastic foam material. These containers are typically used by proprietors of restaurants, taverns, nightclubs, and other venues that serve beverages and snacks. Proprietors may prefer reusable containers to disposable containers for economical and ecological advantages.

Proprietors recognize the benefit of encouraging their patrons to retain a single vessel during an excursion to the venue. In particular, it is beneficial for patrons to use a vessel and present the vessel for refilling in order to cut down on costly and time consuming washings. Also, by reusing a single container, the patron reduces the possibility of inadvertently exchanging vessels with another patron, thereby decreasing exposure to harmful pathogens. Furthermore, retaining and repurposing a vessel as a storage container for other items after its initial use as a drinking vessel provides ecological and environmental advantages by reducing waste attendant with disposable vessels. Therefore, there is also a need for a vessel adapted to accommodate and store both consumable and collectible items.

SUMMARY OF THE INVENTION

According to the present invention, a vessel for containing substances includes a hollow body resembling a musical instrument for containing the substances, a power source for powering a sound module and a light source, and at least one activation switch for activating the sound module and light source.

According to another feature of the present invention, the power source, sound module and activation switches may be disposed on a head of an elongated neck attached to the body and the light source may be disposed on the elongated neck.

According to another feature of the present invention, a removable, refillable and cleanable insert may be received in the hollow body for easily refilling and cleaning the insert and for preventing liquid from fouling the activation switch, sound module, light source and power supply.

According to yet another feature of the present invention, a closure may be provided having an opening to receive coins and a straw and may include threads adapted to mate with a threaded opening of the body.

DETAILED DESCRIPTION OF EMBODIMENTS

Figure 1:
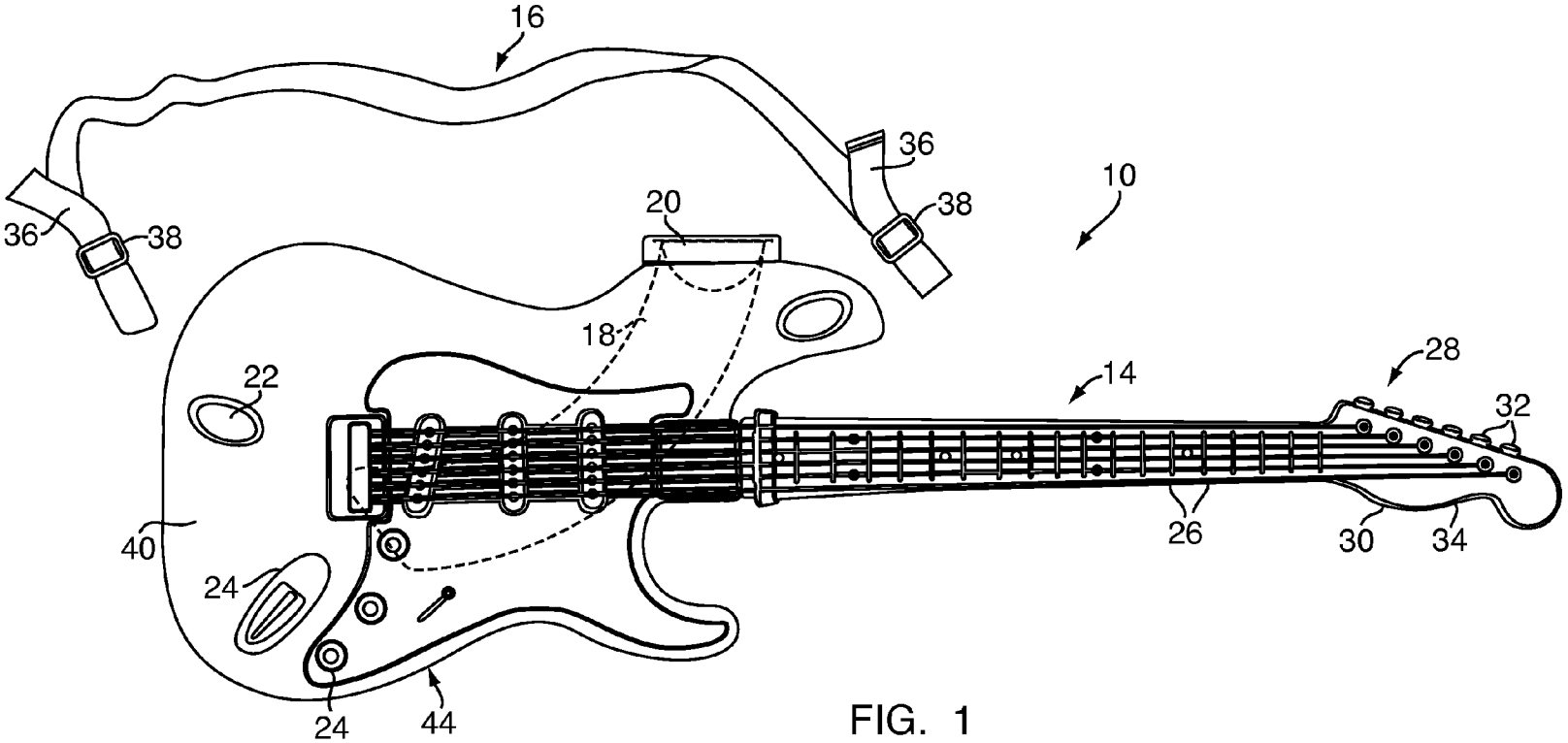
FIG. 1 is a front view of one embodiment of a vessel in the shape of an acoustic guitar having a light source, sound module, activation switches, power source, a closure and a strap, according to the present invention.

Referring to FIG. 1, a vessel 10 of the present invention includes a body 12, an elongated neck 14 connected to the body 12 and a strap 16 attachable to the body 12. The vessel 10 also includes a removable insert 18 and a closure 20. The body 12 includes apertures 22 for securing the strap 16 to the body 12 and molded decoration elements 24. The neck 14 includes one or more light sources 26 and a head 28 having a sound module 30, one or more activation switches 32 for activating the light source 26 and the sound module 30, and a power source 34 (not shown) for powering the light source 26 and sound module 30.

The strap 16 includes two ends 36 and each of the two ends 36 further includes a buckle 38 for securing each end to a main portion 86 of the strap 16. Each end is receivable through one ore more apertures 22 formed within the body 12. The strap 16 is preferably fabricated from nylon, but it will be appreciated that any material having flexible properties may be employed, such as, for example, rubber, gross grain ribbon, fabric, or any other material.

Figure 2:
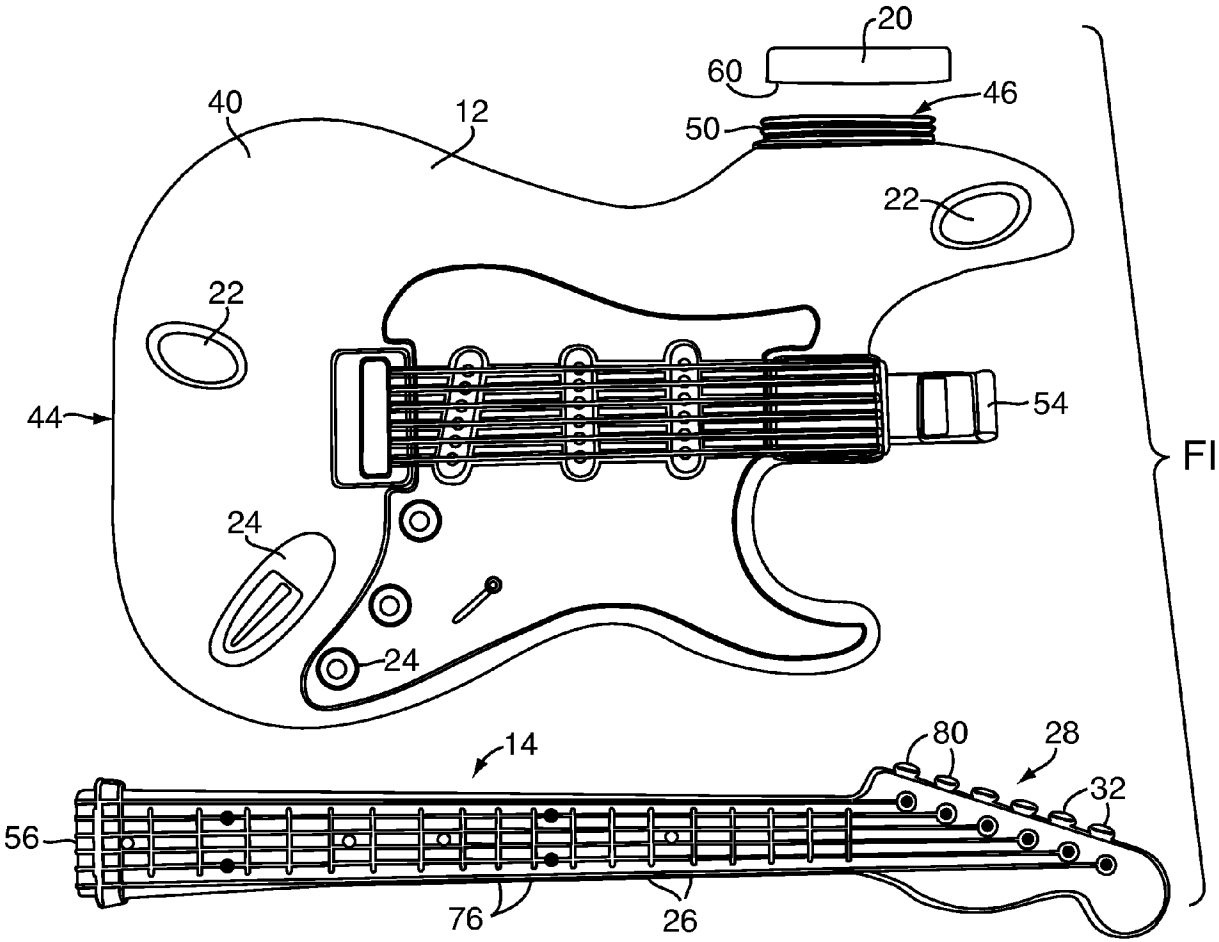
FIG. 2 is a front view of the vessel of FIG. 1.
Figure 3:
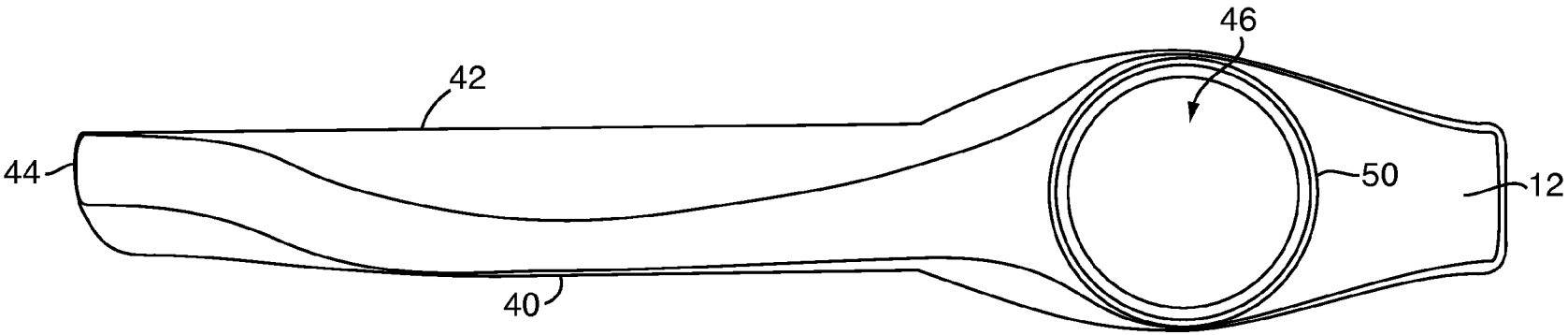
FIG. 3 is a top view of the vessel of FIG. 1.

Referring to FIGS. 2 and 3, the body 12 of the vessel 10 resembles an acoustic guitar and comprises a first face 40 and a second face 42 opposite from the first face 40 and joined thereto by a sidewall 44 extending along the perimeter of the body 12 forming a hollow interior cavity 46 and an opening 50 thereto. The first face 40, second face 42, and sidewall 44 are molded into an integral unit so that the interior cavity 46 is airtight and suitable for receiving solid or liquid substances. The first face may 40 also include decorative elements 24 to enhance the appearance simulating an acoustic guitar. In the preferred embodiment, the opening 50 formed in the body 12 is threaded and is of sufficient dimensions to receive liquid or solid substances. The body 12 also includes a male member 54 adapted to mate with a female inner end 56 of the elongated neck 14 for secure attachment between the elongated neck 14 and the body 12.

Figure 5:
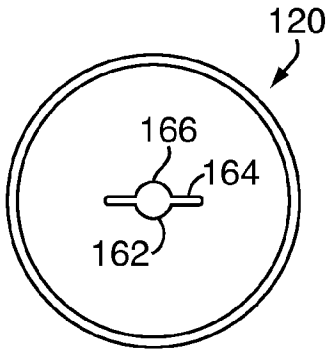
FIG. 5 is a top view of an alternative embodiment of the closure of FIG. 1.
Figure 4:
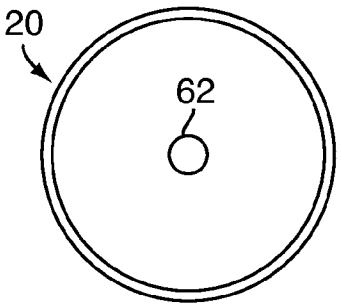
FIG. 4 is a top view of the closure of FIG. 1.

The closure 20 includes threads 60 that are adapted to mate with the threaded opening 50 of the body 12. It will be appreciated that the closure 20 may optionally snap onto the body 12 or attach to the body 12 by any known means. The closure 20 may be provided with a substantially round opening 62 adapted to receive a straw for drawing liquids into an individual's mouth, as shown in FIG. 4. Optionally, as shown in FIG. 5, in an alternative embodiment of the closure, closure 120 may be provided with an opening 162 having an elongated portion 164 and a round portion 166 adapted to receive coins and a straw, as shown in FIG. 5. The embodiment of the closure shown in FIG. 5 makes it possible for the user to retain the vessel 10 as a coin bank after retiring the vessel 10 from use as a drinking vessel 10. It will also be appreciated that the closure 20, 120 could be provided without an opening whereby contents may be consumed directly from an opening (not shown) formed in the body 12.

Figure 6:
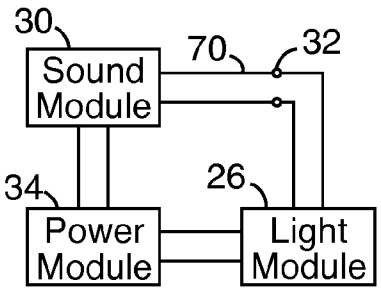
FIG. 6 is a schematic view showing the interconnection of the light source, sound module, activation switches and power source of the vessel of FIG. 1.

The power source 34, which may be one or more batteries, is contained in a battery compartment (not shown) disposed within the head 28 of the neck 14. As shown in FIG. 6, the power source 34 is electrically connected by connecting wires 70 to the sound module 30, which includes one or more speakers (not shown). The power source 34 is also electrically connected by the connecting wires 70 to the light source 26. In the preferred embodiment, the light source 26 comprises LED lights resembling one or more frets 76 of a guitar, as shown in FIG. 2. Optionally, some or all of the frets 76 may be light sources 26. It will be appreciated that the light sources 26 may comprise LCD lights, incandescent lights, fluorescent lights, xenon lights, or any other light source 26. The activation switches 32 are electrically connected by the connecting wires 70 to the light source 26 and sound module 30. In the preferred embodiment, the activation switches 32 resemble tuning pegs 80 of a guitar, as shown in FIG. 2. Optionally, some or all of the tuning pegs 80 may be activation switches 32.

Figure 7:
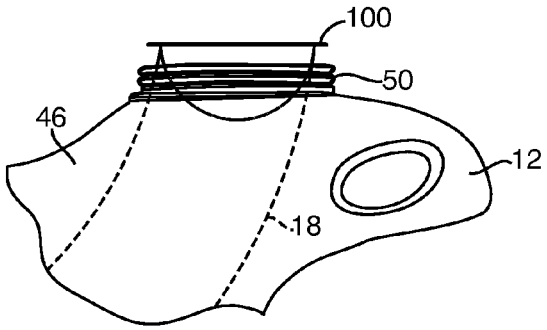
FIG. 7 is a side view of an insert receivable in the body of the vessel of FIG. 1.
Figure 8:
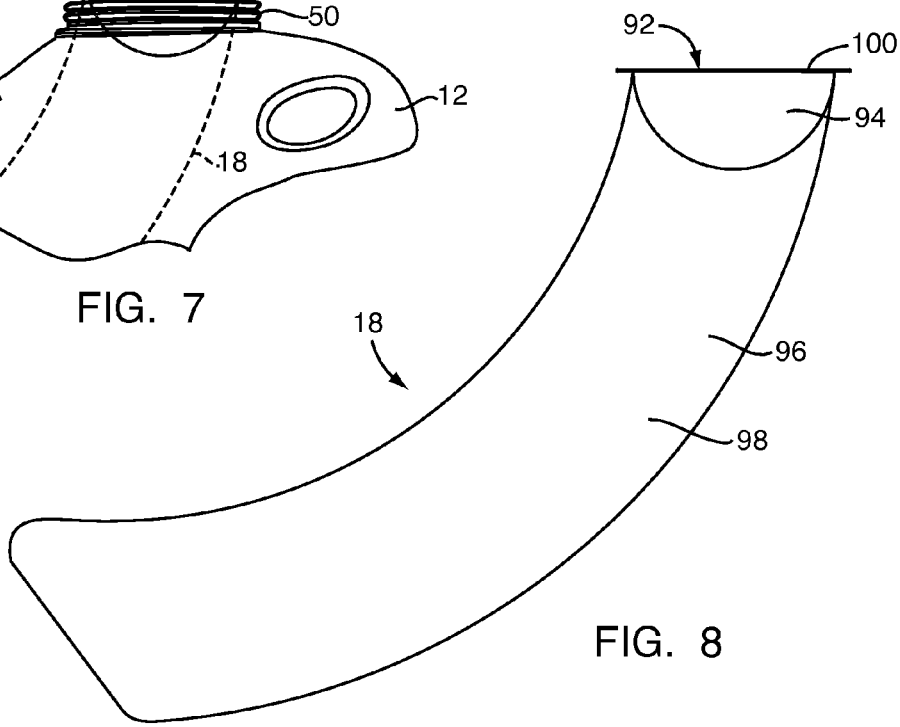
FIG. 8 is a side view of the insert of FIG. 7.
Figure 9:
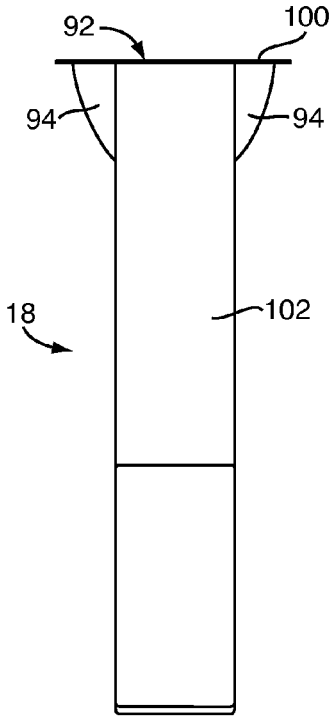
FIG. 9 is a front view of the insert of FIG. 7.
Figure 10:
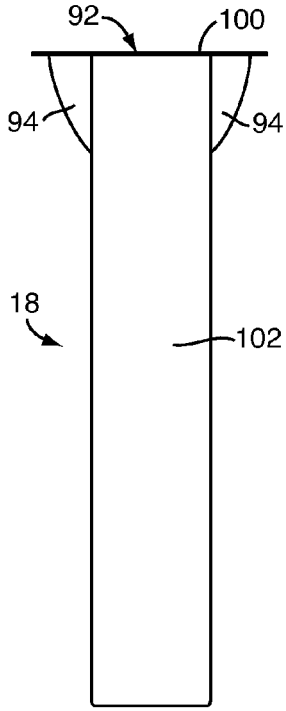
FIG. 10 is a rear view of the insert of FIG. 7.

Referring to FIG. 7, the removable insert 18 is receivable within the hollow interior cavity 46 of the body 12 through the opening 50 formed within the body 12. Referring to FIGS. 8-10, the insert 18 is adapted to slide into the body 12 and includes a substantially cylindrical mouth 92, a bulbous neck 94, an elongated portion 96 forming a hollow interior cavity 98, and a lip 100. The elongated portion 96 is curved so that the body 12 may receive the insert 18 interiorly. The lip 100 projects outwardly from the mouth 92 of the insert 18 and supports the insert 18 on the opening 50 formed within the body 12. The lip 100 is adapted to rest on the opening 50 and does not interfere with the threaded relationship between the threaded opening 50 of the body 12 and the threaded closure 20. Thus, the insert 18 may be employed without disrupting the ability to enclose the contents of the vessel 10.

Figure 11:
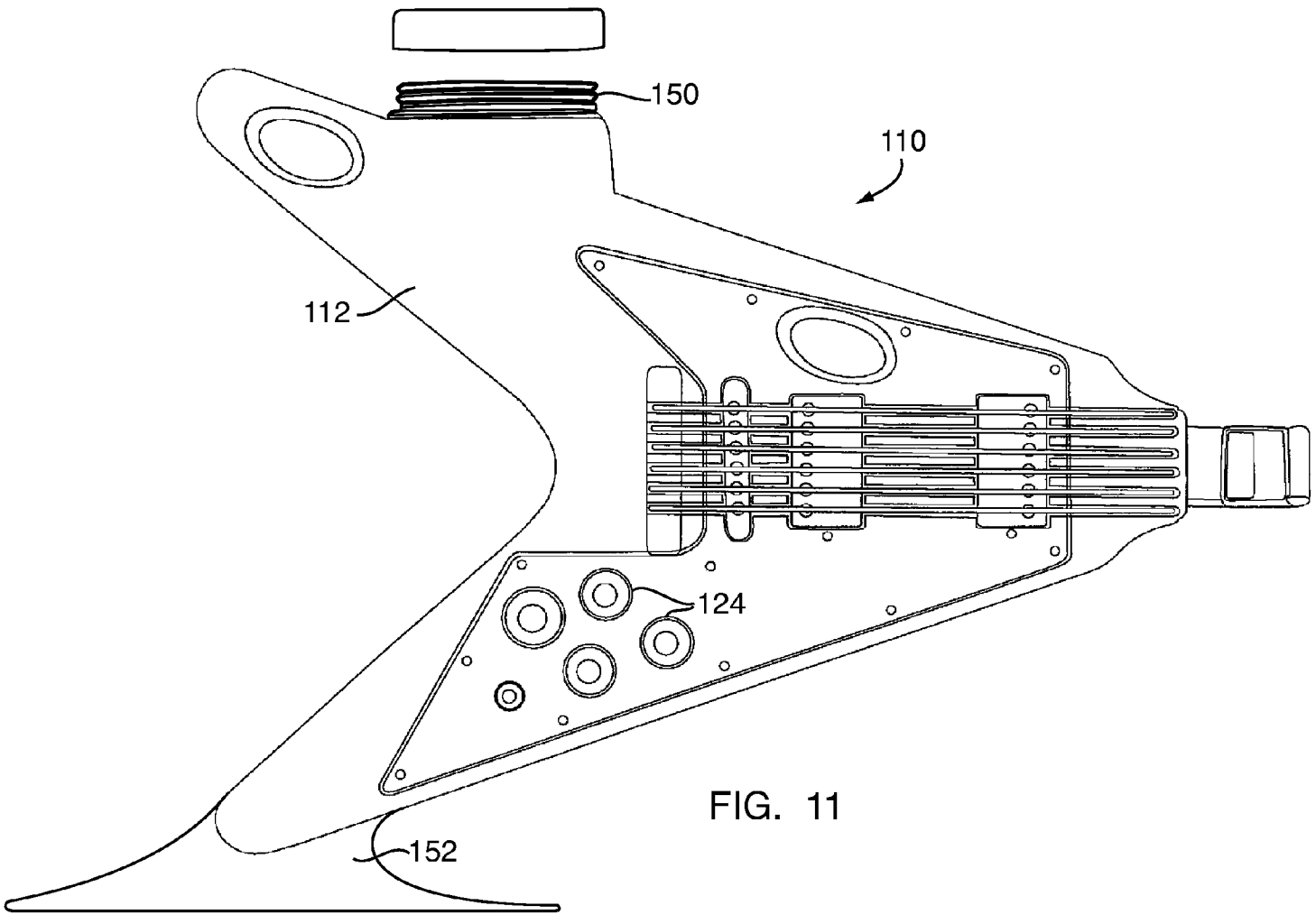
FIG. 11 is a front view of an alternative embodiment of the vessel according to the present invention shaped as an electric guitar and including a flat base.

Referring to FIG. 11, according to another embodiment of the present invention wherein like numerals represent like elements, vessel 110 includes a body 112 resembling an electric guitar and includes decorative elements 124, an opening 150, and a base 152. The decorative elements 124 resemble features of an electric guitar. The base 152 is flat for standing the vessel 110 upright on a flat surface for storage of coins or other objects.

Figure 12:
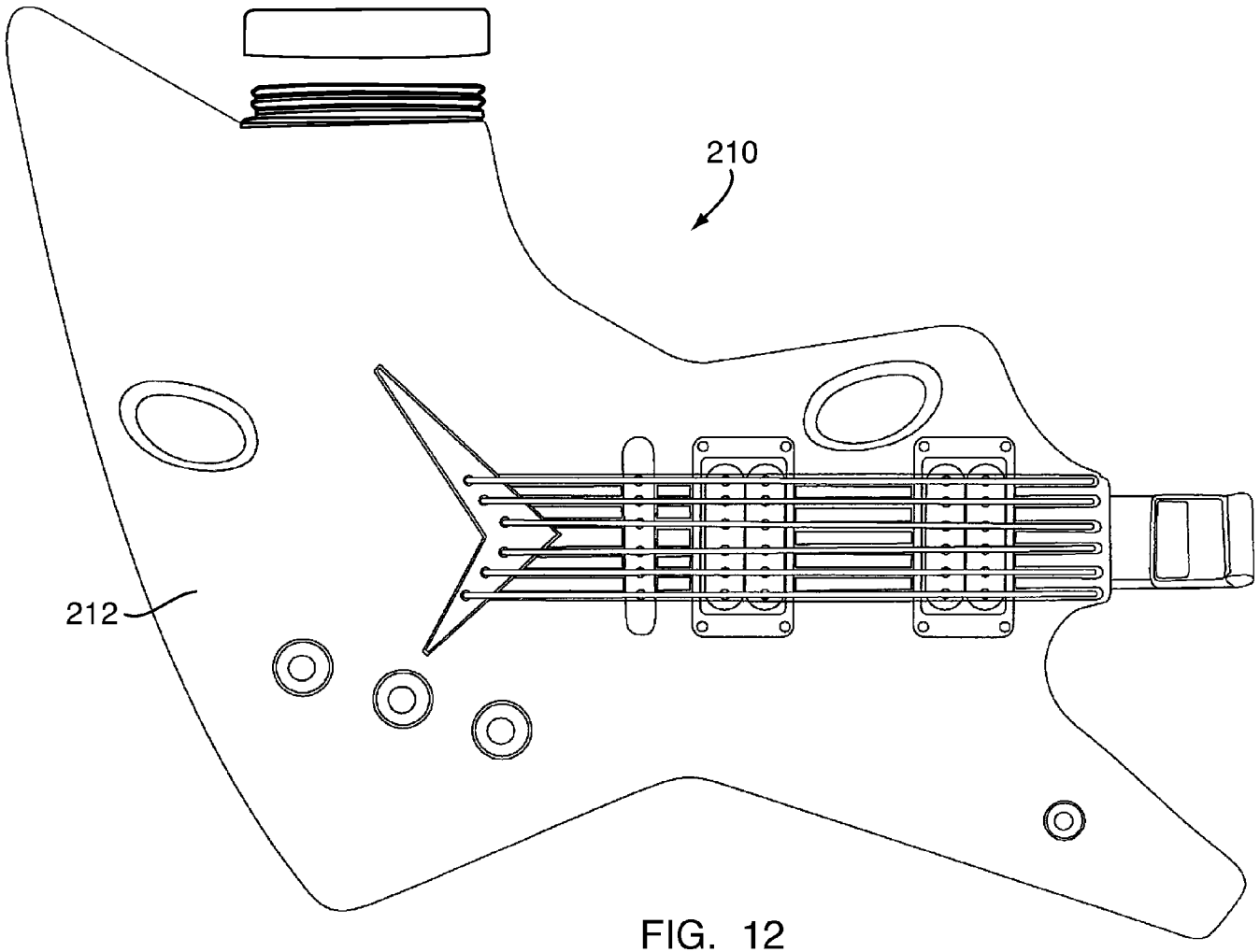
FIG. 12 is a front view of another embodiment of the vessel according to the present invention.

Referring to FIG. 12, according to another embodiment of the present invention wherein like numerals represent like elements, vessel 210 includes a body 212 resembling another type of electric guitar. As may be appreciated, the body 212 may be provided in the shape of a violin, banjo, mandolin, or other musical instrument.

The vessel 10, 110, 210 is preferably fabricated from a rigid material capable of containing beverages or other substances. As may be appreciated, the body 12, 112, 212 may be fabricated from any material suitable for containing substances, including but not limited to snacks, beverages and coins. For example, the body 12, 112, 212 may be fabricated from glass, plastic, plastic foam, ceramic, or metal. Additionally, as will be appreciated, the body 12, 112, 212 and/or the elongated neck 14 may be transparent, translucent or opaque. Furthermore, the body 12, 112, 212 may be fabricated from an insulating or non-insulating material. Optionally, the body 12, 112, 212 may be fabricated from a flexible material, so long as the material is capable of containing beverages or other substances. It may be appreciated that the body 12, 112, 212 may be of any style, shape, or size, and may include a handle, a stem, a straw, or a drinking spout.

In operation, the two ends 36 of the strap 16 are threaded through the apertures 22 in the body 12 and back through the buckles 38 to secure attachment of the strap 16 to the body 12. The vessel 10 may then be worn in a conventional manner. The closure 20 is twisted off of the threaded opening 50 of the body 12 and the insert 18 is removed from the hollow interior cavity 46 of the body 12. The insert 18 may be filled with liquid or solid substances. Empty or full, the insert 18 may be replaced within the body 12 and the closure 20 is twisted to close the opening 50 formed within the body. Optionally, a straw may be inserted into the opening 62, 162 provided in the closure 20 to aid in drinking from the vessel.

To operate the entertainment features of the vessel 10, the activation switches 32 are depressed, sending an electrical signal via the connecting wires 70 to the light source 26. The light source 26 illuminates upon reception of the signal. The activation switches 32 also send an electrical signal via the connecting wires 70 to the sound module 30, which emits an audible tone or tones upon reception of the signal. Both the light source 26 and sound module 30 draw power from batteries housed in a battery compartment disposed in the head 28 of the elongated neck 14. Both the illumination emitted from the light source 26 and audible tones emitted from the sound module 30 may be utilized to attract attention.

The present invention offers many advantages over existing devices adapted to containing beverages, snacks or coins. The primary advantage of the present invention is the flexibility of use provided by the removable insert 18. In particular, the insert 18 effectively decreases the usable volume inside the body 12. This may be advantageous when the vessel 10 is used in a tavern or nightclub venue because filling the body 12 to capacity could cause the body 12 to become too heavy to carry for extended periods of time. For example, if the body 12 is shaped as a life-size guitar, the insert 18 provides a structure for containing a lesser amount of liquid, such as twenty-four (24) liquid ounces or similar conventional portion.

Another advantage to the present invention is the versatility of the vessel. For example, if the insert is not employed, liquids or solids may be poured directly into the hollow interior cavity 46 of the body 12. If the insert 18 is employed, the insert 18 may be refilled while disposed within the interior cavity 46 of the body 12. Optionally, the insert may be removed from the body 12 and refilled. This may be advantageous in situations when a tavern or nightclub is crowded and it would be difficult to pass the relatively large body 12 to the server for filling.

Yet another advantage to the present invention is its ability to be worn. This is particularly advantageous when the vessel 10 is filled with a heavy substance and is worn in a crowded tavern or other venue. For example, wearing the vessel 10 may decrease the possibility of spillage when navigating through a crowded venue. Similarly, freeing one's hands allows an individual to activate entertainment features such as the light source 26 and the sound module 30 by depressing the activation switches 32.

In addition to providing entertainment, the light and sound features are advantageous for other reasons. For example, nightclubs and taverns are often noisy and crowded. The light sources 26 are advantageous because they allow the user to communicate with a server or waiter through visual cues over a loud ambient noise. Similarly, a restaurant patron could signal for a waiter's attention across a dining room by depressing the activation switch 32 to illuminate the light source 26 without the need for waving his or her hand.

Another advantage to the present invention is its adaptability to different types of use. For example, as discussed above, the vessel 10 can be used for drinking purposes at a tavern, nightclub, or restaurant. The vessel 10 can also be worn during trips or other errands to drink or snack while freeing an individual's hands. The vessel 10 can also be employed for storage purposes, for example, as a piggy bank or a vessel 10 for other collectible items. One or more closures 20 may be provided with the vessel 10 to provide adaptability for different types of use. For example, a closure 20 may be provided with a straw or an opening 62 for a straw 64, or with an opening 66 adapted to receive coins.

While the present invention has been described with reference to the preferred embodiments, it will be understood by those skilled in the art that various changes may be made, and equivalents may be substituted for elements thereof, without departing from the essential scope of the present invention. For example, although the invention has been described as having a closure 20, it will be appreciated that the vessel 10 could function without a closure 20. Likewise, the present invention has been described as including the strap 16 secured to apertures 22 formed in the body 12. It will be appreciated, however, that the strap 16 could support the body 12 at a single aperture formed in the body 12 or multiple apertures 22 formed in the body 12. Likewise, one or more loops could be formed externally from the body 12, elongated neck 14 or head 28 for receiving the ends 36 of the strap 16. Optionally, the two ends 36 of the strap 16 could include clips for clipping onto the apertures 22, or the two ends 36 could be secured to the body 12 by any known means. Alternatively, the vessel 10 could be provided without a strap. For example, the body 12 could be formed with a handle or other structure for carrying the vessel 10. Similarly, although the present invention has been described as shaped in the likeness of a musical instrument, any shaped body 12 could be provided. Furthermore, the sound module 30, light source 26, power source 34 and activation switches 32 have been described in relation to the head 28 and the elongated neck 14. It will be appreciated, however, that the sound module 30, light source 26, power source 34 and activation switches 32 could be disposed in the body 12 of the vessel 10. Furthermore, although the elongated neck 14 and body 12 have been described as separate structures, the elongated neck 14 and body 12 could be provided as a single, molded integral unit. Therefore, it is intended that the invention include all embodiments falling within the scope of the appended claims.

What is claimed is:

1. A vessel for containing substances comprising:

a hollow body resembling a musical instrument having an opening therein;

a removable insert having an elongated portion forming a hollow interior cavity with a mouth at one end thereof, the removable insert receivable within said body through said opening and adapted to contain the substances in the hollow interior cavity;

a power source disposed on the body;

a sound module electrically connected to and powered by said power source;

at least one light source electrically connected to and powered by said power source; and at least one activation switch electrically connected to said power source and said light source for activating said light source and said sound module.

2. The vessel of claim 1, additionally comprising a closure adapted to close the opening;

wherein the removable insert is adapted to slide into said opening and to be clamped between the closure and the body.

3. The vessel of claim 1, comprising an elongated neck having a head and the elongated neck is attached to the body.

4. The vessel of claim 3, wherein the power source, sound module and at least one activation switch are disposed on the head and the light source is disposed on the elongated neck.

5. The vessel of claim 4, wherein the power source is at least one battery housed in a battery compartment disposed on the head of the elongated neck.

6. The vessel of claim 3, wherein the at least one light source is a fret integral with the elongated neck.

7. The vessel of claim 3, wherein the at least one activation switch resembles at least one tuning peg.

8. The vessel of claim 3, wherein the elongated neck includes a female inner end adapted to mate with a male member extending from the body.

9. The vessel of claim 1, wherein the opening formed in the body is a threaded opening.

10. The vessel of claim 1, comprising a threaded closure adapted to mate with the opening of the body.

11. The vessel of claim 10, wherein the threaded closure includes a substantially round opening adapted to receive a straw.

12. The vessel of claim 10, wherein the threaded closure includes an elongated opening adapted to receive coins.

13. The vessel of claim 10, comprising a closure adapted to snap onto the body.

14. The vessel of claim 1, comprising a strap having two ends for supporting the body.

15. The vessel of claim 14, comprising at least one aperture formed in said body wherein the at least one aperture is adapted to receive at least one end of the strap.

16. The vessel of claim 1, wherein the body is formed in the shape of a guitar.

17. The vessel of claim 1, comprising a flat base disposed on the body adapted to supporting the body on a flat surface in an upright position.

18. A vessel for containing substances comprising:

a hollow body resembling a body of musical instrument having a threaded opening therein;

a removable insert having an elongated portion forming a hollow interior cavity with a mouth at one end thereof, the removable insert receivable within said body through said threaded opening and adapted to slide into said opening and to contain the substances in the hollow interior;

an elongated neck having a head and attached to the hollow body;

a power source disposed on the head of the elongated neck;

a sound module electrically connected to and powered by said power source;

at least one light source electrically connected to and powered by said power source;

at least one activation switch connected to said power source and said light source for activating said light source and said sound module; and a threaded closure adapted to mate with said threaded opening formed within said body.

19. The vessel of claim 18, wherein the removable insert comprises a lip adapted to rest upon at least a portion of the threaded opening.

20. The vessel of claim 19, wherein the threaded closure closes the insert and clamps the lip between the threaded closure and the portion of the threaded opening.

* * * * *